US006892610B1

(12) United States Patent
Gunter

(10) Patent No.: US 6,892,610 B1
(45) Date of Patent: May 17, 2005

(54) AUTOMOTIVE MIRROR REMOVAL TOOL

(76) Inventor: Richard Gunter, 107 1st St., Melrose, FL (US) 32666-3030

( * ) Notice: Subject to any disclaimer, the term of this patent is extended or adjusted under 35 U.S.C. 154(b) by 142 days.

(21) Appl. No.: 10/225,577

(22) Filed: Aug. 23, 2002

(51) Int. Cl.[7] ..... B25B 7/02
(52) U.S. Cl. ..... 81/424.5; 29/268; 81/426.5
(58) Field of Search ..... 29/268; 81/417, 81/424.5, 426, 426.5

(56) References Cited

U.S. PATENT DOCUMENTS

| | | | | |
|---|---|---|---|---|
| 636,587 | A | 11/1899 | Sylvester | |
| 2,478,881 | A * | 8/1949 | Wayrynen | 29/268 |
| 2,526,180 | A * | 10/1950 | Gros | 81/426 |
| 2,967,303 | A | 1/1961 | Wise | |
| 3,308,863 | A * | 3/1967 | Schall | 81/426 |
| 3,635,435 | A | 1/1972 | Perison, Sr. | |
| 3,964,352 | A | 6/1976 | Dukes | |
| 4,569,552 | A | 2/1986 | Marks | |
| 5,485,770 | A | 1/1996 | Popelak | |
| 5,730,033 | A * | 3/1998 | Mitrowski | 81/424.5 |
| 5,901,736 | A * | 5/1999 | McCauley et al. | 81/426 |

* cited by examiner

*Primary Examiner*—James G. Smith
(74) *Attorney, Agent, or Firm*—Sven W. Hanson

(57) ABSTRACT

The present invention pertains to tools particularly designed to remove replaceable rear-view mirrors from the inside of automotive windshields. The present invention is a tool specifically shaped and sized to grasp a windshield mounted removable automobile mirror base and move a locking tab away from a mounting pad to remove the mirror without touching the windshield glass. The tool includes a first jaw that has a curved inside surface with a protective surface or coating. A second jaw of this embodiment is spaced and sized to fit under the locking tab without touching the adjacent glass. The two jaws are configured to allow the second jaw to depress the locking tab by biasing the jaws together while the first jaw rests on the mirror base without damaging it.

5 Claims, 5 Drawing Sheets

AUTOMOTIVE MIRROR REMOVAL TOOL

BACKGROUND OF THE INVENTION

The present invention pertains to tools particularly designed to remove replaceable rear-view mirrors from the inside of automotive windshields.

Rear-view mirror frames in automobiles are often used to support and carry other accessories such as interior lights and electronic devices. Consequently, such designs are both heavier, larger, and more expensive than simple mirrors. To make use of these mirrors optional, and to deal with possible repairs, these mirrors are usually mounted in a removable manner. Most removable and replaceable inside mirrors and similar devices are mounted solely to the inside surface of the windshield. Due to the size and weight of the mirrors, a secure and reliable mount is problematic. An often used solution is a metal mounting pad that is bonded to the windshield surface. The mounting pad is provided with rails or other structures that movably connect with a connection structure on a mirror. This connection structure is typically located on the foot of a support leg protruding from the back of the mirror. This interface between the mounting pad and mirror must be both very stiff to prevent movement of the mirror surface and very strong to prevent accidental damage. To remove the mirror, it must be possible to separate this interface. One design that is used extensively in the automotive industry to meet these requirements is a connection structure that includes mating rails and a stiff but resilient tab that locks the connection structure to the mounting pad. In use, the tab is elastically bent from its resting condition to enable the mirror to be slid from the mounting pad rails. Both to ensure a secure connection, and to hamper theft, the tab is very stiff and cannot be displaced by hand alone. A prior tool is available and is used for the particular purpose of displacing the tab to effect removal of the mirror. This prior tool is essentially a simple lever that is designed to bear against the adjacent windshield. An unforseen consequence of the use of this prior tool is that when it displaces the tab, the reactive forces on the windshield break the windshield. This is a common occurrence, costing significant money. Services such as automobile repair and windshield tinting are greatly hampered by the risk of windshield breakage when removing a mirror. Often, an otherwise inexpensive procedure, such as changing mirrors, results in large added cost in replacing a more expensive windshield. The majority of windshield breakage in this way occurs in automotive repair centers that have access to a great variety of tools. However, this situation continues and no alternative tool is yet available. One difficulty in resolving this problem is that great care is required to protect the surfaces of both the windshield and the adjacent surfaces including those of the mirror frame. The exposed surfaces of the mirror frame and mirror support leg are generally designed for aesthetics and covered with relatively fragile plastics and the like. Risk of damaging these parts impedes the design of methods and tools that might be used in mirror removal. Another problem is the location and surroundings of the mirror and mount. Because the windshield inside surface is typically sloping and spaced from the set of the automobile, and hence not easily accessible, it is difficult to apply the necessary force to the connection tab. What is needed is a tool that can depress a mounting connection tab as described without contacting the adjacent glass and without harming the mirror surfaces. At the same time, it must allow movement of the mirror to slide it from the mounting pad. The tool should also be operated by one hand of the user to ease placement and use.

SUMMARY OF THE INVENTION

The present invention is a tool specifically shaped and sized to grasp a windshield mounted removable automobile rearview mirror base and move a locking tab to remove the mirror without touching the windshield glass. The tool includes protective surfaces particularly designed to bear on, without damaging, the exposed surfaces of the mirror base. The invention includes methods of use of the tool including moving the tool with the mirror base as the mirror is removed from a glass surface mounted pad. In one embodiment, the tool includes a first jaw having a curved inside surface with a protective surface or coating. A second jaw of this embodiment is spaced and sized to fit under the locking tab without touching the adjacent glass. The two jaws are configured to allow the second jaw to depress the locking tab by squeezing the jaws together while the first jaw rests on the mirror base without damaging it. The two jaws are offset perpendicular to the line of tab depression motion to obtain the required alignment. The tool may be moved with the mirror base until the tab is disengaged and the mirror then removed. In a second embodiment, the first jaw includes an arm configured with a slot to be placed around an elongated support leg of a typical mirror to securely position the tool to allow use without movement of the tool against the surface of mirror base.

The invention provides a novel tool that solves the problem of removing replaceable automotive rearview mirrors without glass breakage. Other advantages of this novel invention as described in the following drawings, detailed description, and claims will be apparent to one skilled in the art.

DESCRIPTION OF THE PREFERRED EMBODIMENTS

Figure 1:
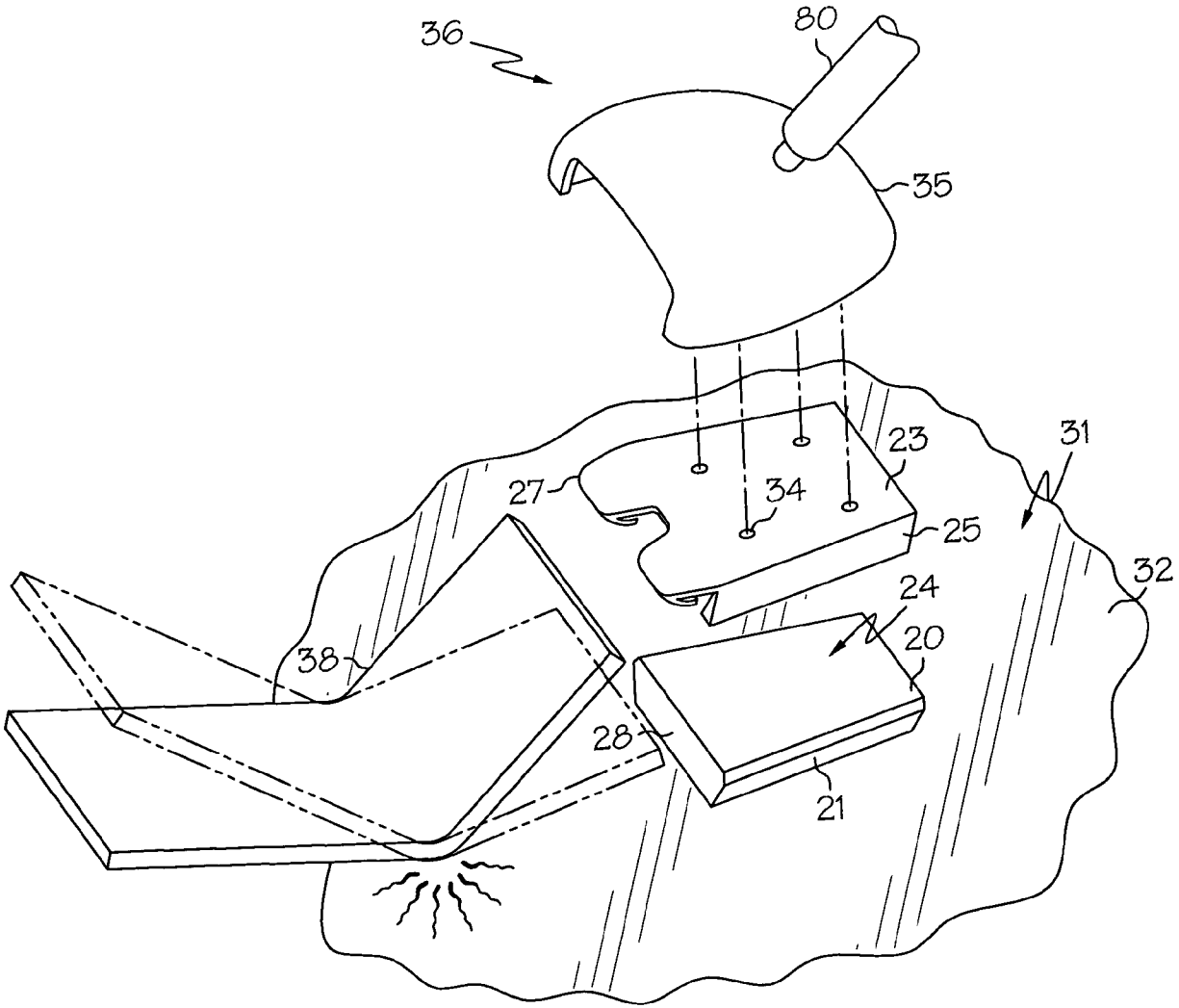
FIG. 1 illustrates the elements of a typical removable mirror assembly and a prior art tool for removal.

FIG. 1 illustrates a typical removable rear-view mirror base and a tool of the prior art for assisting in removing the mirror, the manner of use of which is now described. A mounting pad 20 is permanently bonded to the inside surface 31 of an automotive windshield 32. Typically, the windshield 32 is oriented in a vertical sloped manner. However, for clarity in the figure, the orientation is shown generally horizontal. The mounting pad 20 includes sloped rails or side shoulders 21 extending along opposite sides of the mounting pad 20. A mounting bracket 23 includes angled clips 25 on opposite sides of the bracket 23. The clips 25 are configured to slide tightly onto the shoulders to secure the bracket 23 to the mounting pad 20. One or more locking tabs 27 extend from an end of the bracket 23 and between the clips 25. The tabs 27 are placed with respect to the clips such that they may be elastically displaced by a mounting pad mounting surface 24 as the bracket 23 is slid onto the mounting pad 20. The tabs 27 then resiliently "snap" back over the end 28 of the mounting pad 20 at a point when the bracket 23 is stopped. Removal of the bracket may only be accomplished by elastically deforming the tabs 27 in a direction away from the glass surface 31 and beyond the plane of the mounting surface 24 to allow the clips 25 to slide back in an opposite direction over the rails 21. The bracket 23 includes holes 34 by which it is secured by fasteners to a mirror base 35. In this way, a mirror or other device may be securely mounted to a windshield and yet be readily removed. This method of mounting is well known. The side shoulders, clips and tabs must be very stiff to ensure the tight and rigid connection necessary for automotive mirrors. As a consequence, the tabs are not easily deformed for removal. To enable this operation, a lever tool 38 is provided in the prior art. The lever tool 38 is essentially a lever that, in use, is positioned to bear against the window surface to exert a deforming force away from the surface and against the tabs. In the figure the lever tool 38 is shown in two orientations to demonstrate its motion in use. This contact and force on the windshield often result in breaking the windshield. Herein, "removable" and "replaceable" are used to indicate devices that are designed and enabled to be separated and reattached multiple times without damage and without addition of new materials for reattachment. Example mounting pads as contemplated here for removable mirrors are identified by part number 15954649 of the General Motors Corporation. A typical replacement mirror including bracket fitting the described mounting pad is identified by part number 15007600 of the General Motors Corporation and is sold under the trademark Metagal (™). The assembly of these parts is described in General Motors Corporation "Light Truck Manual"; Figure TS16-565-02/25/94. Other similar devices may exist or may be designed in the future.

Figure 2:
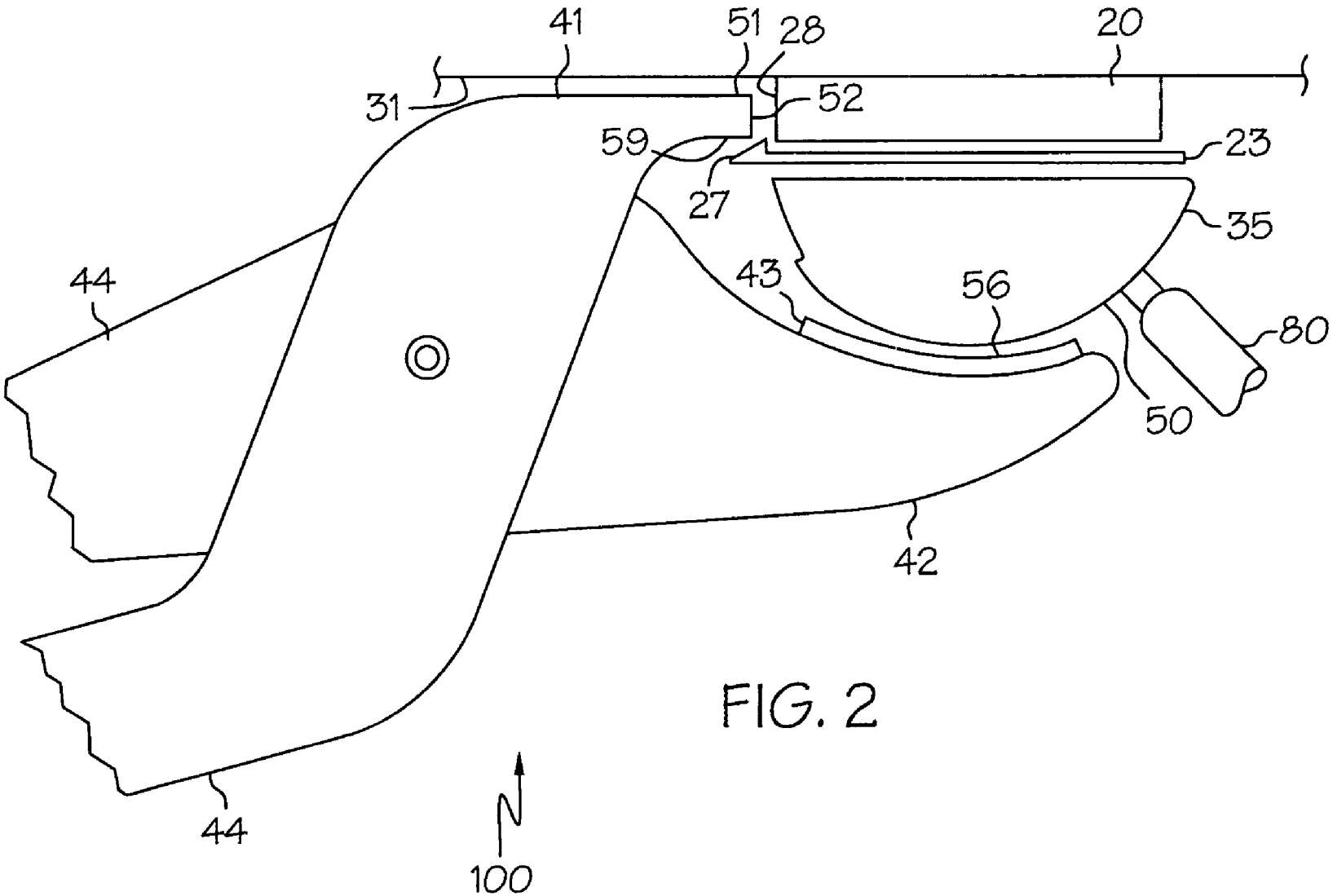
FIG. 2 is a cross-section view of one embodiment of the invention.

FIG. 2 illustrates in cross-section one embodiment of the present invention applied to a typical removable mirror. In the figure, the mounting pad 20, bracket 23, and mirror base 35 are essentially the same as discussed above. The invention includes two jaws 41,42 connected by means of biasing them together. In the embodiment shown, this is accomplished by mutually pivoting handles 44 (shown in part) that extend from the jaws. The handles are configured to be operated by one hand of the user. A tab jaw 41 has a distal portion 51 that is sized to fit between the glass surface 31 and the tab 27 without touching the glass surface 31. The tab jaw 41 has a contact surface 59 facing the saddle jaw 42 at the distal portion 51. In operation, downward movement of this contact surface 59 forces the tab downward and clear of the mounting surface to enable removal of the bracket 23 and mirror base 35 from the mounting pad 20. Herein the term "downward" and "upward" are relative to the illustrations and to the relative positions of the structures, for explanation purposes, and are not limiting on the manner and orientation of the applications of the invention. The opposing saddle jaw 42 includes a curved pad 43 of rubber which forms a protective surface 56. Rubber here means natural rubber, or plastic, or like materials being compliant or softer than structural materials such as metals. The curved pad 43 and protective surface 56 are sized and shaped to receive the curved body of the mirror base 35. In operation, the tool is placed as shown and the handles 44 squeezed to bias the jaws 41,42 together. The saddle jaw 42 is anchored on the relatively large and fixed mirror base to which the tab jaw 41 is then drawn. The relatively less stiff tab 27 is thereby displaced as desired. The distal end 52 of the tab jaw 41 is preferably spaced laterally from the mounting pad end 28 a distance sufficient to allow the jaws 41, 42 to move together with the mirror base and bracket as they are slid back over the mounting pad until the tab 27 is held above the mounting pad 20 by the mounting surface 24. In this operation, the reacting force previously absorbed by the windshield by use of the prior art tool is instead absorbed by the mirror base. The handles 44 must be oriented with respect to the distal end 52 to be clear of the windshield when deforming the tab 27 and moving with the mirror.

The mirror base of most replaceable mirrors is designed in part for aesthetics and marring by tools would reduce their value. For that reason, the mirror base surface 50 must be protected from the potentially deleterious effects of tools. This is problematic as most replaceable mirror bases are luxury items formed from relatively soft, and often textured, automotive interior plastics. For this reason, the saddle jaw 41 should accurately fit the curvature of the mirror base and have a protective surface for contacting the mirror base. Other protective surfaces are contemplated, such as a polished surface. However, a compliant surface such as the pad described above is preferred for its additional ability to compensate for minor variations in mirror base curvature and tool placement. One form of the pad may be formed as a thin layer of room temperature vulcanizing (RTV) material such as a silicone rubber or "liquid" plastic of the type commonly used to form tool handles. Preferably, a pad of such materials has an average thickness in the range of 0.030 to 0.040 inches which provides the needed protection without interfering with fit. The pad may also be cut from bulk rubber and bonded to the jaw. To maximize contact area and thereby reduce contact forces, the concave protective surface 56 of the saddle jaw and pad should match the convex curvature of the mirror base. For matching typical mirror bases, the radius of curvature 53 of the inside protective surface 56 of the jaw is preferably about 1.8 inches to maximize contact over the length of the surface. A larger radius, greater than about 2.5 inches will result in relatively point contact, an insecure fit and potential marring of the mirror surface finish. A smaller radius jaw, less than 1.5 inches, may prevent the tool from engaging and may also mar the mirror finish. Some deviation of jaw curvature may be accepted and accommodated by a thicker and softer jaw surface. The saddle jaw 42 should not have protrusions, teeth or other contact points of hard materials such as metal. For future mirror bodies contemplated having other than curved bodies, the saddle jaw should receive the mirror body in a manner to prevent slipping.

Figure 3:
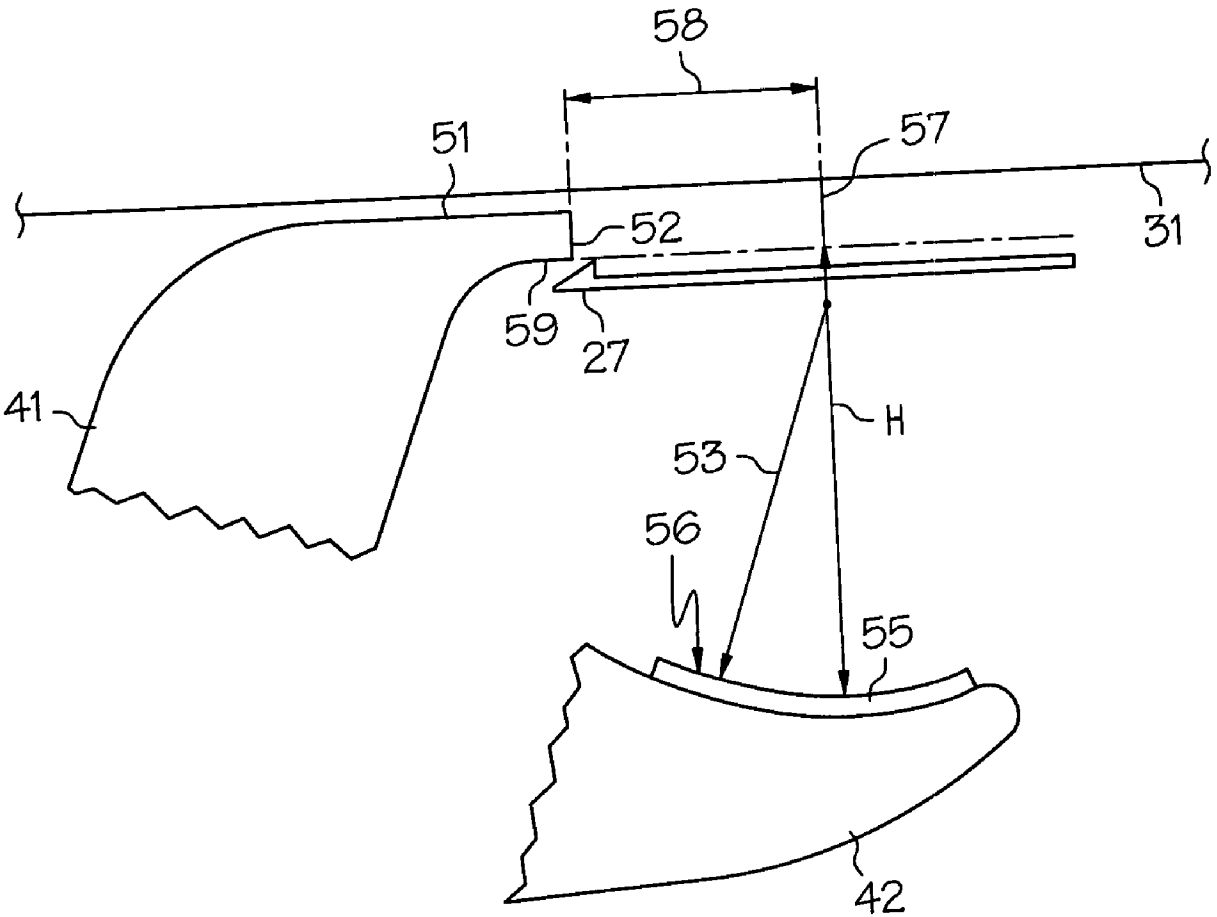
FIG. 3 is a cross-section view of the embodiment of FIG. 2 with relative locations of invention elements.

In use, after the tool is aligned in the approximate orientation to receive the mirror base, proper placement is achieved by centering the saddle jaw 42 on the mirror base 35. The tab jaw 41 will then be inherently positioned between the tab 27 and the windshield glass surface. FIG. 3 illustrates the relative orientation and size of the tool elements to provide this fit. The relative location of the tool jaw elements, to properly align with the mirror base and bracket, can be defined with respect to a trough point 55 of the saddle jaw. The trough point 55 is defined as the point on the saddle jaw protective surface 56 having an axis or line of maximum dimension 57 from, and perpendicular to, the plane of the inside surface 31 of the windshield when the tab jaw 41 is positioned at the tab 27. The line of maximum dimension 57 is also normal to the protective surface 56 at the trough. The line of maximum dimension 57 has a perpendicular offset dimension 58 to the distal end 52 of the tab jaw of 0.75 inches. This offset dimension 58 ensures a separating space between the tab jaw distal end 52 and the mounting pad end 28 as discussed above. This space should be at least 0.09 inches, with the tool engaged and the mirror and bracket fully in place on the pad, to allow the tool to move with the tab and mirror during removal. At the same time, the tab jaw contact surface 59 must be distanced from the trough point 55, and parallel the line of maximum dimension 57, a jaw opening dimension H of 0.8 inches. The combination of jaw opening dimension H and offset 58 defines the invention in terms of the physical connection to the mirror and tab required for removal. The thickness dimension of the tab jaw 41 at the distal end 52 must be less than the vertical gap between the windshield surface and the tab. Preferably, the jaw thickness is less than 0.175 inches to ensure contact is not made with the windshield.

The protective surface 56 is preferably at least 1.0 inches long in the circumferential direction along the jaw, but should be no greater than 1.5 inches to fit existing typical mirror bases. A greater length will likely interfere with the mirror support leg 80. From the trough point 55, the protective surface 56 should extend distally along the protective surface 56 preferably 0.5 inch to provide adequate bearing surface but no more than 0.65 inches to avoid interference. The tool preferably has a width W (FIG. 4) in the range of ½ to ⅝ inches at the tab jaw distal end to fit between supports on the mirror base (not shown) yet engage the entire tab width. Otherwise, the tool width may be greater at the saddle jaw, although a greater width is not beneficial if not curved in the transverse direction. A tool saddle jaw width less than ½ inches will provide unsatisfactory grip on a mirror base. The saddle jaw may be curved in the direction transverse to the circumferential direction to better mate with the mirror base, but a straight width tool is satisfactory.

Figure 5:
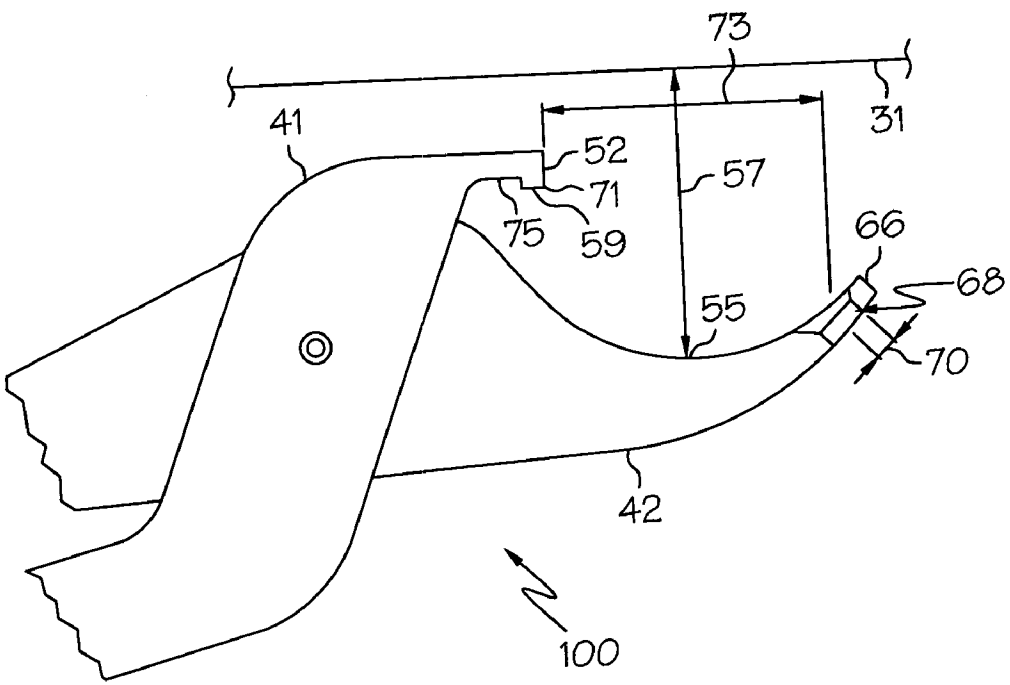
FIG. 5 is a side view of the embodiment of FIG. 4.
Figure 4:
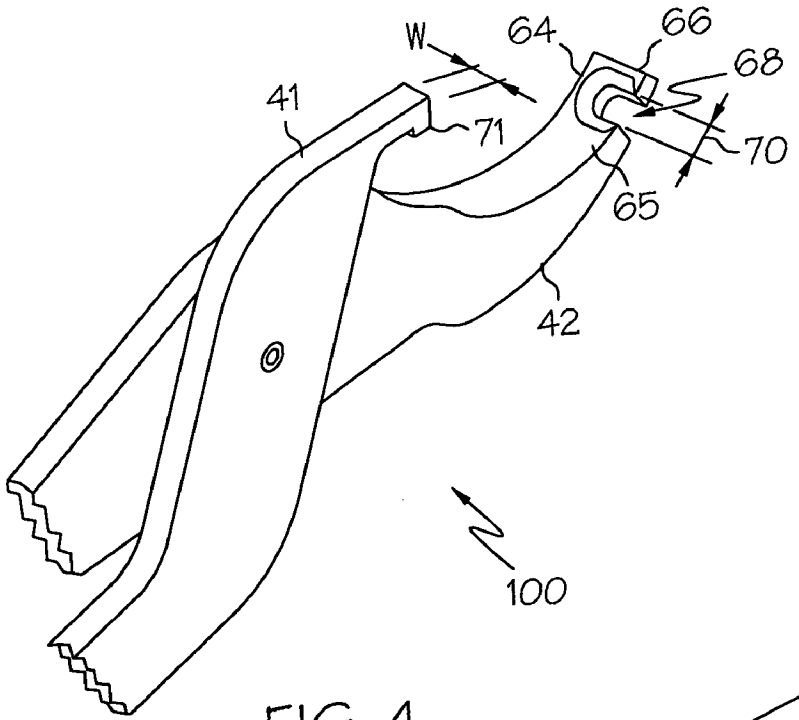
FIG. 4 is a perspective view of a preferred embodiment of the invention.
Figure 6:
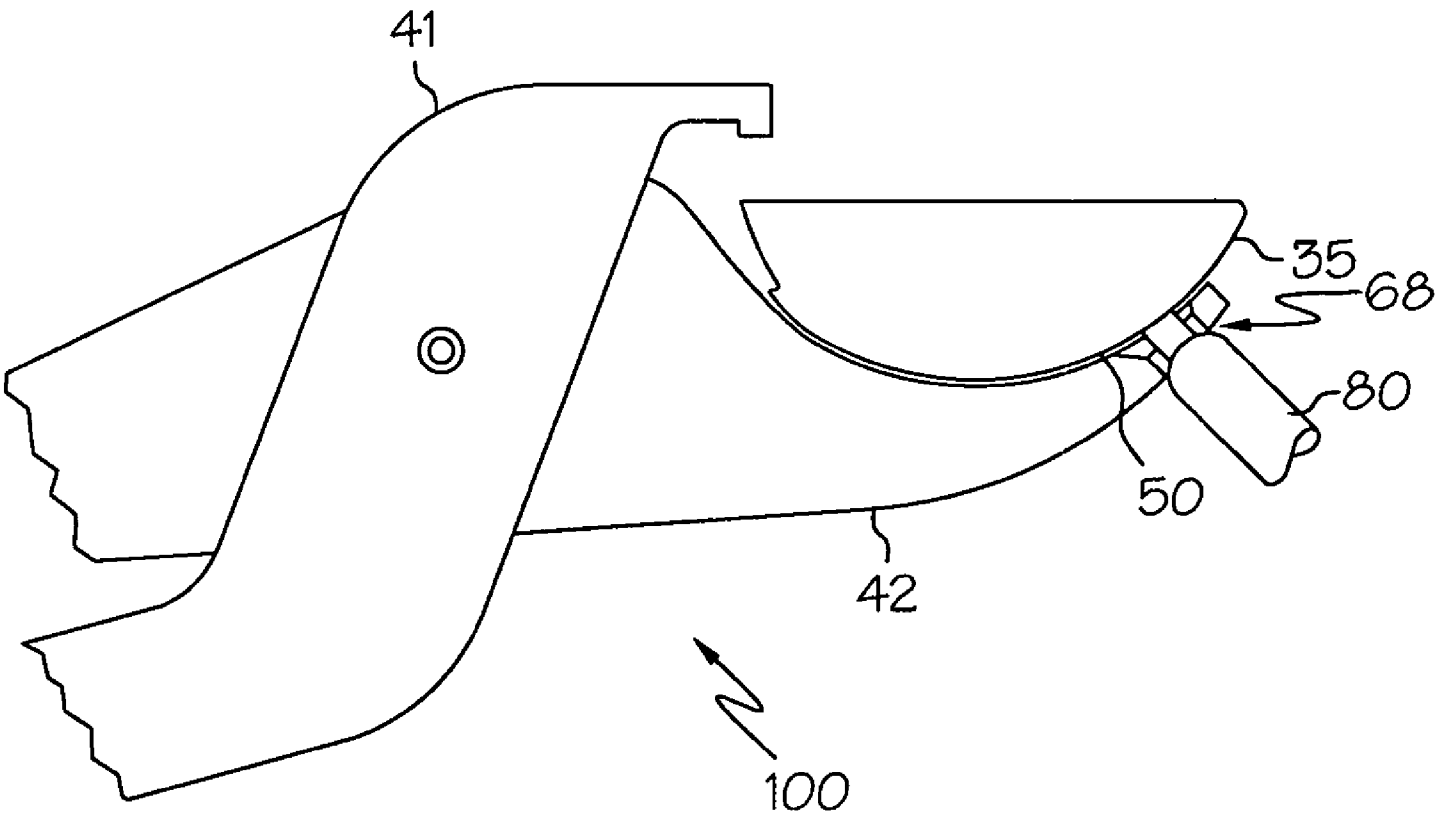
FIG. 6 is a side view of the embodiment of FIG. 4 as used on a removable mirror base.

FIG. 4 is a perspective illustration of a preferred embodiment of the tool 100. The configuration of the common elements of this embodiment is as discussed with respect to the previous embodiment. In addition, the saddle jaw 42 includes an anchor arm 64 that extends distally from the saddle jaw distal end 65. The anchor arm 64 includes a lateral portion 66 that is spaced from the saddle jaw distal end to define a slot 68. The slot 68 is angled and sized to allow the anchor arm 64 and lateral portion 66 to engage a mirror support leg 80 and secure the position and movement of the tool. The slot has a slot width 70 of at least 0.38 inches between the saddle jaw distal end 65 and the lateral arm 66 for a typical mirror. The slot is most easily formed by boring a circular hole in an extended portion of the saddle jaw and then cutting the side out. Alternative construction methods will be obvious, including, for example, casting the finished shape. The slot is also preferably beveled as shown to better mate with the mirror base. Preferably, the slot is formed oversized and then coated or otherwise covered in a protective coating as discussed above. FIG. 4 also illustrates the tool width W and the tab jaw 41 with a downward extending finger 71 placed at the jaw distal portion 51 to engage the tab. FIG. 5 is a side view of the embodiment of FIG. 4. The centerline of the slot at the protective surface has a slot distance 73 of 1.5 inches to the distal end of the tab jaw, perpendicular to the line of maximum distance 57. The slot distance must be effective and true simultaneous with the above jaw opening dimension H and offset 58 dimension to provide proper fit and action. A tab jaw throat portion 75 is vertically offset from the contact surface 59 a distance of about 0.12 inches to ensure the jaw clears the end of the tab 27. This throat portion 75 preferably extends at least a distance of 0.30 inches from the distal end 52 (away from the pad in use) to ensure that only the tab jaw finger 71 contacts the tab and adjacent the pad. If the tab jaw bears on the end of the tab it may be impossible to release the tabs. This is because the tabs are typically constructed of a folded portion of the bracket that add flexibility that is not accessed unless the tabs are properly acted upon. In use, this embodiment of the tool is first engaged with a mirror support leg by slipping the slot, sideways, onto the support leg as shown in FIG. 6. The saddle jaw is then settled onto the mirror base, the tab jaw coming naturally in position. The handles (not shown) of the tool are squeezed to force the tab jaw against the tab, thereby unlocking the bracket. The saddle jaw absorbs the reactive forces generated. In this embodiment, the protective surface is a thin layer of plastic that, for clarity, is not shown. The embodiment of FIGS. 4, 5, and 6 provides a very sure and certain placement of the tool on the mirror body. The tool must not be allowed to slip or twist in use. Such relative movement between the tool and mirror greatly increases the chance of damage to the mirror body surface and appearance. The element of the jaw finger 71 is also contemplated in an alternative embodiment otherwise as shown in FIG. 2.

The dimensions defined above are relative to one condition of the jaws. Other conditions of the jaws may be possible with the tool and these other conditions may not satisfy the above requirements. In particular, tools having pivoting handles to bias jaws may have infinite possible configurations. The invention is defined by a structure providing at least one condition in which the inventive requirements are present and the desired functions are provided. It is contemplated that future mirror bodies may have other than curved bodies or may have various dimensions. The embodiments shown include handles that are used to bias the two jaws together. Other means of accomplishing this operation are contemplated. Various mechanisms are known for this operation and their incorporation will be obvious to one skilled in this art. In particular, multi-pivot mechanisms which provide purely linear motion of the jaws are contemplated. An additional alternative embodiment includes a frame and screw jack to locate and move the jaws as described herein. Most preferably, the tool is operable by one hand to enable easy use in the confines of an auto compartment. The tool may be most conveniently formed of tool metals such as steel and then protective surfaces added as discussed.

In all embodiments, a critical requirement is that all elements of the tool remain distant from the glass to safeguard it. This may be stated also that the tool remains on the same side of the plane of the windshield surface as the mounting pad. The invention includes methods of removing such mirror devices by applying structures as herein described. As used herein, the term "mirror" is intended to refer to an assembly of components that include at least one mirrored surface and associated frame and support elements.

The preceding discussion is provided for example only. Other variations of the claimed inventive concepts will be obvious to those skilled in the art. Adaptation or incorporation of known alternative devices and materials, present and future is also contemplated. The intended scope of the invention is defined by the following claims.

I claim:

1. A tool for removing automotive rearview mirrors mounted on a glass windshield wherein such mirrors include a bracket tab required to be displaced away from the glass windshield for removal of the mirror, the tool comprising:

a first jaw having a curved protective surface for receiving a removable mirror base;

a second jaw having a distal portion separated from the protective surface and configured to engage the locking tab of a removable mirror when an associated mirror base is received in the protective surface, the distal portion having a thickness equal to, or less than, 0.175 inches and a width less than ⅝ inches; and means of biasing the second jaw toward the protective surface; and wherein:

the protective surface has a trough point;

the distal portion has a contact surface facing the protective surface, the contact surface offset a first dimension from the trough point; and the distal portion has a distal end, the distal end offset a second dimension from the trough point, the second dimension orthogonal to the first dimension; and wherein the first dimension is 0.8 inches, and the second dimension is 0.75 inches.

2. A tool according to claim 1, wherein:

the first jaw further comprises:

a slot for receiving a mirror support leg.

3. A tool according to claim 2, wherein:

the slot has a slot width of at least 0.38 inches.

4. A tool according to claim 3, wherein:

the slot is a distance of 1.5 inches from the distal end, parallel the second dimension.

5. A tool for removing removable automotive rear-view mirrors, the tool comprising:

a first jaw having a curved protective surface, the protective surface having a radius of curvature of 1.8 inches and the protective surface having a trough point, the trough point having a normal axis normal to the protective surface at the trough point;

a second jaw having a distal end and an adjacent orthogonal contact surface; and means of biasing the second jaw toward the protective surface in at least a first condition;

wherein in the first condition:

the distal end is offset 0.75 inches orthogonal from the normal axis while the contact surface is separated a distance of 0.8 inches from the trough point along the normal axis.

* * * * *